United States Patent [19]

Ehrgott et al.

[11] 4,325,044

[45] Apr. 13, 1982

[54] MOUNT FOR AN ELECTROMAGNETIC COIL

[75] Inventors: Roland Ehrgott, Munich; Gerhard Meindl, Alling, both of Fed. Rep. of Germany

[73] Assignee: Siemens Aktiengesellschaft, Berlin & Munich, Fed. Rep. of Germany

[21] Appl. No.: 127,811

[22] Filed: Mar. 6, 1980

[30] Foreign Application Priority Data

Mar. 30, 1979 [DE] Fed. Rep. of Germany ... 7909134[U]

[51] Int. Cl.[3] ..... H01F 27/26

[52] U.S. Cl. ..... 336/67; 336/210; 403/354

[58] Field of Search ..... 336/65, 67, 68, 210; 403/398, 354, 155; 310/217, 218

[56] References Cited

U.S. PATENT DOCUMENTS

| | | | |
|---|---|---|---|
| 2,456,458 | 12/1948 | Somerville | 336/210 X |
| 3,238,404 | 3/1966 | Spiess | 336/210 |
| 3,760,316 | 9/1973 | Czewski et al. | 336/210 |
| 3,766,643 | 10/1973 | Arrington et al. | 336/210 X |
| 4,095,206 | 6/1928 | Hishiki | 336/210 X |

FOREIGN PATENT DOCUMENTS

| | | | |
|---|---|---|---|
| 525489 | 1/1954 | Belgium | 336/68 |
| 2830128 | 1/1979 | Fed. Rep. of Germany | 336/210 |
| 1447932 | 6/1966 | France | 336/67 |

OTHER PUBLICATIONS

Siemens Data Book 1975/76, "Weichmagnetiches Siferrit- und Sirufer-Material", pp. 372–378.

*Primary Examiner*—Thomas J. Kozma

*Attorney, Agent, or Firm*—Hill, Van Santen, Steadman, Chiara & Simpson

[57] ABSTRACT

A holder for retaining mirror symmetric E core halves of an electromagnetic core structure consists of angle pieces each having a leg disposed parallel to abutting sides of the E core halves and each having another leg extending around a straight outer surface of one of the halves. The parallel legs engage a retaining plate and terminate in threaded ends for receiving bolts to force the E core halves together and retain the halves by pressure exerted on the outer surfaces of the halves. The threaded ends of the angle pieces extend a sufficient distance for utilization of the holder to mount the electromagnetic core on a circuit board.

8 Claims, 5 Drawing Figures

MOUNT FOR AN ELECTROMAGNETIC COIL

BACKGROUND OF THE INVENTION

1. Field of the Invention

The present invention relates to holders for electromagnetic coil cores, and in particular to such a holder for retaining such cores which are comprised of E core halves.

2. Description of the Prior Art

A common method for constructing a core to receive an electromagnetic coil winding is that of joining opposed mirror symmetric E-shaped core halves with a coil winding holder inserted therebetween and retained thereby. Each E core half has opposed outer parallel legs forming the exterior surface of the completed core, as well as a centrally disposed center leg which receives the coil winding holder.

In connection with electromagnetic coils having small light weight E cores, of the type described, for example, in Siemens Data Book 1975/76 "Weichmagnetisches Siferrit- und Sirufer-Material", pages 372–378, it is known to use a spring bar as a holder for the coil unit comprised of the joined opposed E core halves with the coil winding held therebetween. For electromagnetic coils having larger and heavier E cores, it is known to utilize stronger leaf-springs to press the core halves together. The use of springs of this type results in an uneven application of pressure along the surfaces of the electromagnetic coil which can result in deviations in the air gap dimensions between the central legs of the E core halves which hold the coil windings. Such air gap deviations result in undesired changes in the electric and magnetic values of the coil which either require a constant monitoring of those values, or prevent utilization of the coil in certain applications.

Another holder is known in the art for use with E core halves having cylindrical central legs which consists of a U-shaped sheet metal frame and a cross arm which snaps into the frame. Retaining tension is supplied by an equalizer spring. This type of holder is not only very expensive, but is also mechanically unstable and is therefore unable to withstand vibration.

SUMMARY OF THE INVENTION

It is an object of the present invention to provide a holder for an electromagnetic coil consisting of opposed E core halves which retains the E core halves in abutting relation and exerts a constant force over the surfaces of the halves to maintain a substantially constant air gap within the core.

It is a further object of the present invention to provide such an electromagnetic coil holder which can be inexpensively manufactured and assembled and which provides a high resistance to vibration.

The above objects are inventively achieved in an electromagnetic coil mount consisting of a retainer which has parallel legs which are received in grooves or bores in the sides of the E core halves and which has a central member which extends across a solid side of one of the E core halves. The ends of the parallel legs terminate in threads and engage a retainer plate held in place by bolts to exert a constant pressure on the opposed solid surfaces of the E core halves. By exerting a constant pressure along these opposite surfaces of the halves, a substantially constant air gap is maintained between those portions of the halves which support and retain the coil windings. The coil windings are held on a holder received between the halves which also has solder lugs thereon for connection to other circuit elements.

The threaded ends of the retainer extend a sufficient distance so that the mount can be utilized to retain the coil in a circuit board, as well as to hold the parts of the coil together.

In one embodiment of the invention the retainer is comprised of a one piece U-shaped rod which extends around three sides of the core and receives the retainer plate along the fourth side of the core. In another embodiment, two parallel rods are disposed in grooves or bores in the abutting legs of the core halves, and each rod terminates at one end in an angle for retaining a first plate along one edge of one of the core halves, and each rod terminates at an opposite end in a threaded end which is received in a second retaining plate held in place by bolts.

DESCRIPTION OF THE PREFERRED EMBODIMENTS

Figure 1:
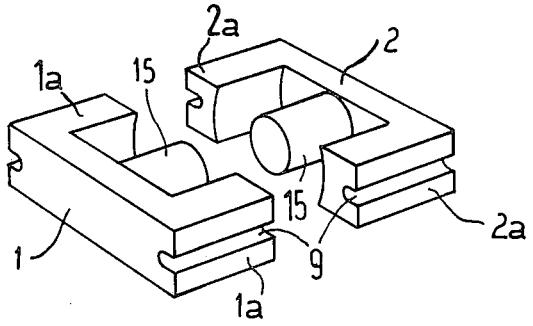
FIG. 1 is a perspective view of opposed E core halves which form an electromagnetic core.

Two mirror symmetric E core halves are referenced in FIG. 1 at 1 and 2. The halves 1 and 2, when joined, form a core for an electromagnetic coil. Each half 1 and 2 has outer legs respectively referenced at 1*a* and 2*a*, and a central cylindrical leg 15. Each leg 1*a* and 2*a* has a longitudinal groove 9 which together form a continuous groove when the halves 1 and 2 are joined.

Figure 2:
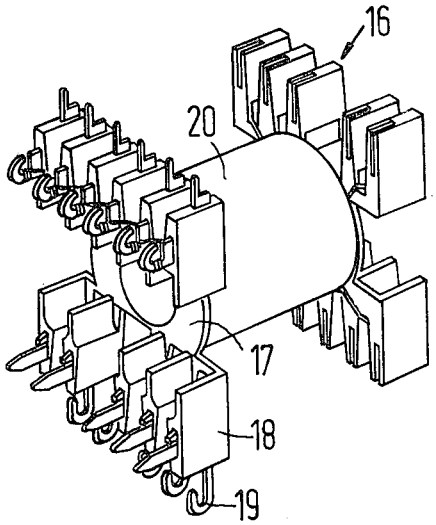
FIG. 2 is a perspective view of a bobbin for receiving a coil winding having solder lug receptacles thereon.

A coil bobbin of the type which may be utilized in connection with the core halves shown in FIG. 1 is illustrated in FIG. 2 generally at 16. The bobbin 16 consists of a cylindrical coil holder 17 around which the coil 20 is wound. The bobbin 16 has a plurality of solder terminal lug receptacles 18, each having a slot into which a solder terminal lug 19 is forced and retained. Each lug 19 may optionally be connected with a termination of the winding 20, in order to accommodate differing circuit requirements.

Figure 3:
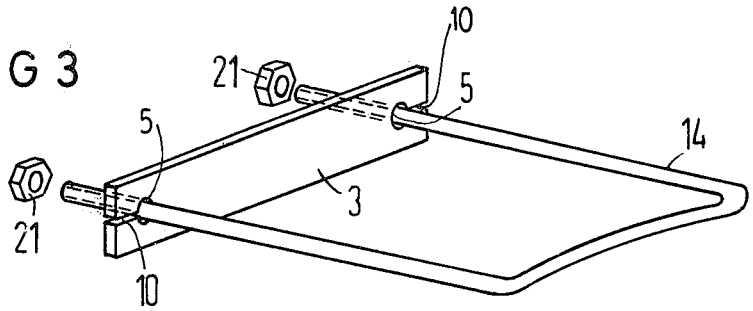
FIG. 3 is a perspective view of a two-piece embodiment of the core holder disclosed herein.

A first embodiment of the holder disclosed herein is shown in FIG. 3 which consists of a continuous U-shaped retainer 14 and a retainer plate 3. The retainer plate 3 is provided with a pair of bores 5 spaced inwardly from the sides of the plate 3 and also has a pair of slots 10 which extend from each bore 5 to the edge of the plate 3. The retainer 14 is inserted in the bores 5 and pressure is applied to the opposite ends of the plate 3 to close the slots 10, thereby retaining the plate 3 in position relative to the retainer 14. The ends of the retainer 14 are threaded to receive nuts 21.

Figure 4:
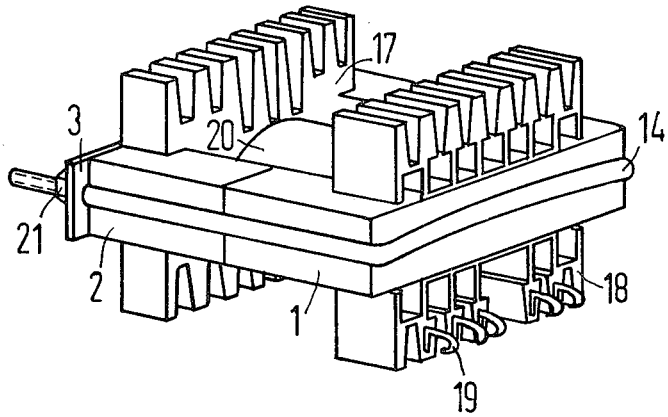
FIG. 4 is a plan view of an assembled core utilizing the embodiment of FIG. 3.

An assembled electromagnetic coil utilizing the holder disclosed herein is shown in FIG. 4. The bobbin 16 is retained by the cylindrical legs 15 of each core half 1 and 2 and the halves are maintained in abutting relation by pressure exerted by the central portion of the retainer 14 and the retainer plate 13 at opposite edges of the core assembly. A uniform retaining force is thus applied across these opposite sides, so that a substantially constant air gap dimension is maintained within the core. As shown in FIG. 4, the threaded ends of the retainer 14 extend a sufficient distance beyond the retainer plate 3 so that the holder may be inserted in a circuit board to mount the coil therein, as well as to retain the core halves in abutting relation.

Figure 5:
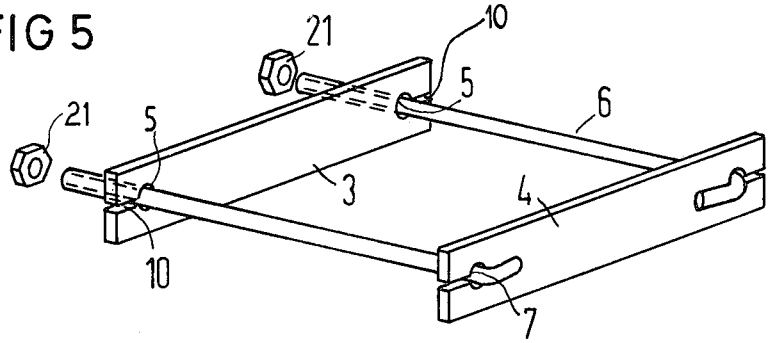
FIG. 5 is a perspective view of a four-piece embodiment of the core holder disclosed herein.

A second embodiment of the holder is shown in FIG. 5 which is a four-piece construction. In the embodiment of FIG. 5, the retainer 14 is replaced by a structure consisting of parallel legs 6 which terminate in angled ends which are received in a second retaining plate 4. The retaining plate 4 is of similar construction to the first retaining plate 3, having a pair of spaced bores therein and slots extending from the bores to the side of the plate which can be forceably closed to retain the rods 6 therein. As in the embodiment of FIG. 3, each rod 6 terminates in a threaded end which is received in the first retainer plate 3 and receive nuts 21. The embodiment of FIG. 5 is utilized to hold the core halves 1 and 2 in abutting relation in the same manner as shown in connection with the embodiment of FIGS. 3 and 4.

It will be understood to those skilled in the art that the grooves 9 in the legs 1*a* and 2*a* may be replaced by longitudinal bores extending through the legs for receiving the retainer 14 or the rods 6.

It will be further apparent that an additional retaining plate may also be utilized in connection with the embodiment of FIG. 3 whereby the center bridge of the retainer 14 presses against the retainer plate and holds the plate against the core half referenced at 1. Such a plate may be of identical construction of those referenced at 3 and 4. Further, in the embodiment of FIG. 5 the plate 4 may be eliminated and the hooked ends 7 of the rods 6 may directly abut and retain the half 1.

Although other modifications and changes may be suggested by those skilled in the art, it is the intention of the inventors to embody within the patent warranted hereon all changes and modifications as reasonably and properly come within the scope of their contribution to the art.

We claim as one invention:

1. In an electromagnetic coil assembly consisting of opposed abutting E core halves each having an end face and each further having a centrally disposed leg and two outer legs, and a hollow coil bobbin carrying a winding which receives said central legs and is disposed between said halves, a mount for said assembly comprising:

a retainer which surrounds an end face of a first E core half and each of said outer legs and which terminates in two threaded ends;

a means in said legs for receiving and aligning said retainer;

a plate having a pair of spaced bores therein for receiving said ends of said retainer for applying equalized retaining pressure against the end face of a second E core half, said plate further having a pair of longitudinal slots therein extending from each of said bores to an exterior edge of said plate, said slots forceably closeable for rigidly affixing said plate a fixed distance from said end face of said first E core half; and a pair of bolts respectively received on said threaded ends to maintain said plate in pressure applying relation to said end face.

2. The mount of claim 1 wherein said retainer is a U-shaped rod having parallel legs received in said means in said E core half legs for receiving and aligning the retainer, and having a central bridge portion joining said parallel legs which abuts the end face of said first E core half.

3. The mount of claim 2 wherein a second plate is disposed between said central bridge of said retainer and said end face of said first E core half, said second plate having spaced bores therein in registry with said bores in said plate which receives the ends of said retainer, said bores in said second plate receiving said parallel legs of said U-shaped rod, said second plate further having a pair of longitudinal slots therein extending from each of said bores to an exterior edge of said plate, said slots forceably closeable for rigidly affixing said plate a fixed distance from said end of said first E core half.

4. The mount of claim 1 wherein said retainer consists of two parallel rods, said rods being received in said means in said legs for receiving and aligning said retainer, and each of said rods terminating in a threaded end and an opposite angled end, each of said angled ends engaging said end face of said first E core half to maintain said first and second E core halves in abutting relation.

5. The mount of claim 4 wherein said retainer is further comprised of a second plate disposed between said angled ends of said rods and said end face of said first E core half, said second plate having spaced bores therein in registry with said bores in said plate which receive said threaded ends, said bores in said second plate receiving said rods, said second plate further having a pair of longitudinal slots therein extending from each of said bores to an exterior edge of said plate, said slots forceably closeable for rigidly affixing said plate a fixed distance from said end of said first E core half.

6. The mount of claim 1 wherein said means in said legs for receiving and aligning said retainer is a groove carried on an outer surface of said legs.

7. The mount of claim 1 wherein said means in said legs for receiving and aligning said retainer is a bore extending through each of said legs.

8. The mount of claim 1 wherein said threaded ends of said retainer extend a distance beyond said plate to form studs for mounting said coil assembly in a circuit board.

* * * * *